United States Patent [19]

Oishi

[11] Patent Number: 4,986,239

[45] Date of Patent: Jan. 22, 1991

[54] IGNITION TIMING CONTROLLER FOR INTERNAL COMBUSTION ENGINE

[75] Inventor: Hiroshi Oishi, Hamamatsu, Japan

[73] Assignee: Sanshin Kogyo Kabushiki Kaisha, Hamamatsu, Japan

[21] Appl. No.: 262,967

[22] Filed: Oct. 26, 1988

[30] Foreign Application Priority Data

Oct. 29, 1987 [JP] Japan ..... 62-274263

[51] Int. Cl.[5] ..... F02P 5/02

[52] U.S. Cl. ..... 123/413; 123/423

[58] Field of Search ..... 123/413, 418, 419, 423, 123/422, 417

[56] References Cited

U.S. PATENT DOCUMENTS

| | | | |
|---|---|---|---|
| 1,522,467 | 1/1925 | Myers | 123/413 |
| 3,935,845 | 2/1976 | Aono et al. | 123/422 |
| 4,445,477 | 5/1984 | Ikeura | 123/417 X |
| 4,543,634 | 9/1985 | Kobayashi et al. | 123/423 X |
| 4,799,469 | 1/1989 | Nagano et al. | 123/419 X |
| 4,852,537 | 8/1989 | Nagano et al. | 123/419 |

FOREIGN PATENT DOCUMENTS

| | | | |
|---|---|---|---|
| 120334 | 9/1979 | Japan | 123/423 |
| 126274 | 6/1987 | Japan | 123/423 |

*Primary Examiner*—Tony M. Argenbright
*Attorney, Agent, or Firm*—Ernest A. Beutler

[57] ABSTRACT

A number of embodiments of spark control mechanisms for spark ignited internal combustion engines in which sudden changes in engine speed such as deceleration are sensed and the spark is advanced from normal under those conditions to prevent uneven running and stalling. In some embodiments, the spark advance is achieved by a mechanical dash pot and in other embodiments this is done electronically.

2 Claims, 6 Drawing Sheets

IGNITION TIMING CONTROLLER FOR INTERNAL COMBUSTION ENGINE

BACKGROUND OF THE INVENTION

This invention relates to an ignition timing controller for an internal combustion engine and more particularly to an improved timing controller that controls the timing of the engine in response to abnormal changes in engine speed as well as to normal changes in engine speed.

It is well known that the ignition systems for internal combustion engines operate to control the spark advance in response to engine speed. Normally, the spark advance is held at a fixed degree of advance during cranking, idle and for a certain phase of low speed operation. The spark is advanced along a curve as the engine speed increases up until a predetermined maximum degree of spark advance. This maximum spark advances normally occurs before wide open throttle of the engine. The spark advance is then held constant as the engine speed continues to increase up to its maximum. Although the exact configuration of the spark advance curve may vary from that as aforedescribed, the general principles apply.

Although spark advance mechanisms of the type as aforedescribed are extremely effective, their effectiveness deteriorates under certain abnormal conditions. For example, if the engine speed is suddenly increased or, more importantly, decreased, there is a likelihood that the normal spark advance curve will not provide the adequate spark timing and poor running or, in extreme instances, stalling may occur. Therefore, systems have been proposed to alter the spark advance curve in response to such external abnormal conditions. For example, reference may be had to U.S. application Ser. No. 229,924, entitled, "Control Means Of Internal Combustion Engine For Marine Propulsion", filed Aug. 8, 1988 in the made of Kazumasa Ito and also to U.S. application Ser. No. 247,748, entitled, "Spark Timing Controller For Spark Ignited Internal Combustion Engine", filed Sep. 21, 1988 in the name of Itsushi Hirukawa, both of which applications are assigned to the assignee hereof, for ignition systems having arrangements to alter the spark advance curve in response to these abnormal conditions. Although these devices certainly act significantly to improve the performance under, extreme conditions and will insure against stalling, these devices are of the generally "on" or "off" type. That is, if an abnormal condition is sensed, the spark advance curve is modified whereas under, normal running conditions no modification occurs. However, the degree of modification which may be required can vary with respect to the severity of the abnormal condition.

It is, therefore, a principal object of this invention to provide an improved ignition timing control for a spark ignited internal combustion engine wherein the normal spark advance is modified in response to the severity of an abnormal condition.

It is a further object of this invention to provide an improved arrangement for controlling the spark timing of an internal combustion engine in response to the magnitude of sensed abnormal conditions.

It is a further object of this invention to provide an improved ignition timing control for an engine that is responsive to all running conditions.

SUMMARY OF THE INVENTION

This invention is adapted to be embodied in an ignition timing control for a spark ignited internal combustion engine which comprises spark control means for providing a first spark advance curve in relation to engine speed under normal changes in engine speed. Means are provided for determining the existence of change in engine speed and means to effect a change in the spark advance from the first spark advance curve in relation to the magnitude of the sensed rate of change of speed.

DETAILED DESCRIPTION OF THE PREFERRED EMBODIMENTS OF THE INVENTION

Figure 1:
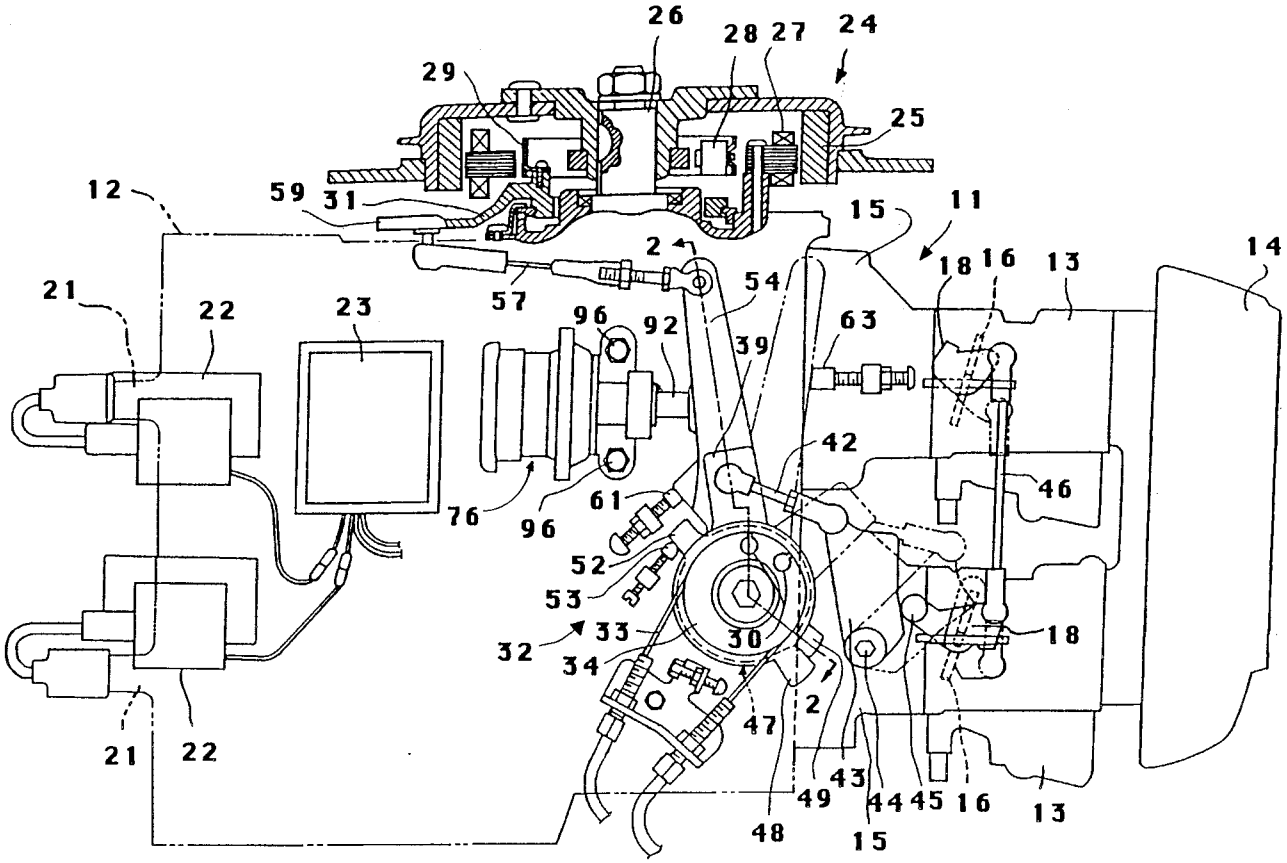
FIG. 1 is a side elevational view of the power head of an outboard motor including an internal combustion engine constructed in accordance with an embodiment of the invention, with a portion broken away.
Figure 2:
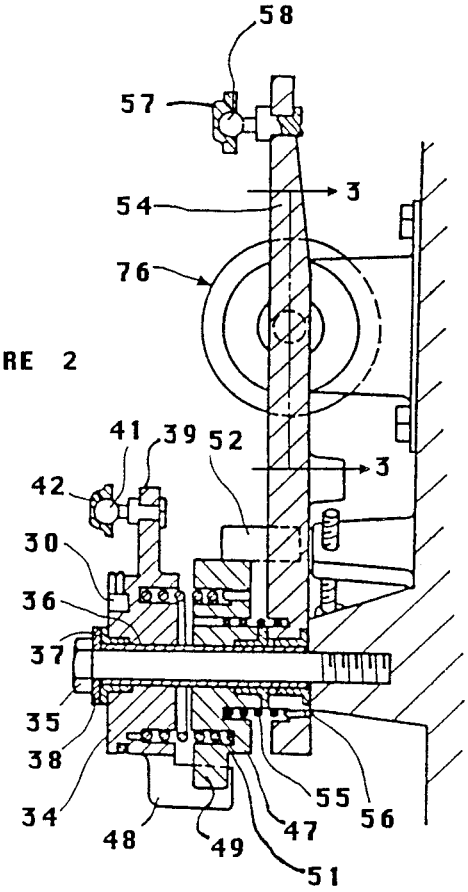
FIG. 2 is an enlarged cross-sectional view taken along the line 2—2 of FIG. 1.
Figure 3:
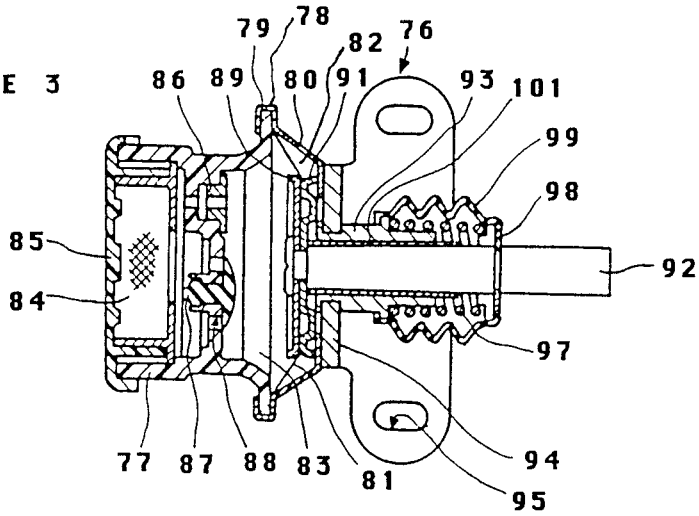
FIG. 3 is a cross-sectional view taken along the line 3—3 of FIG. 2 showing the dash pot in an unloaded state.

Referring first initially to FIGS. 1 through 3, a portion of the power head of an outboard motor is shown. Since the invention relates primarily to the internal combustion engine 11 of the power head only that portion has been shown in detail. Also, it is to be understood that the application of the engine 11 to an outboard motor is to be considered as being exemplary only of the environment in which the invention may be utilized. The invention has wider utility and may be employed with any of the known applications for internal combustion engines.

The engine 11 is depicted as being of the two cycle, crankcase compression type and includes a cylinder block assembly 12 (shown partially in phantom) in which two vertically disposed, horizontally oriented cylinders are formed. Although the invention is described in conjunction with a two cylinder, two cycle, crankcase compression internal combustion engine, the invention may be equally as well practiced with engines having other cylinder numbers or engines operating on other than the two stroke cycle. However, the invention has particular utility in conjunction with spark ignited internal combustion engines.

As is well known with two cycle engine practice, a change is supplied to the crankcase chambers of the engine 11 from a pair of carburetors 13. The carburetors 13 receive inlet air from an air inlet device 14 and form a fuel/air mixture that is discharged through respective intake manifolds 15 to sealed crankcase chambers of the engine 11. The carburetors 13 are shown in more detail in FIG. 6 and reference will had later to that figure. Specifically, however, the carburetors 13 are provided with flow controlling throttle valves 16 that are supported within the body of the carburetor 13 on throttle valve shafts 17 and which have affixed to them externally positioned throttle actuating levers 18.

The charge which has been delivered to the crankcase chambers of the engine 11 is then transferred to the combustion chambers through the internal porting of the engine and is fired by means of spark plugs 21 that are supported within the cylinder head of the engine 11. The spark plugs 21 are provided with respective spark coils 22 which are triggered by a control device 23, in a manner to be described, so as to provide the appropriate spark timing.

This spark system further includes a flywheel magneto assembly 24 that includes a flywheel that carries a plurality of permanent magnets 25 and is fixed for rotation with the output shaft 26 of the engine 11 in a known manner. The permanent magnets 25 cooperate with charging coils 27 that are affixed to the engine cylinder block 12 in a known manner so as to provide a source of voltage. In addition, there is provided a pulser coil 28 for each spark plug that cooperates with the magnets 25 so as to effect a timing control, in a manner to be described. The cooperation of these elements will be described in more detail by particular reference to FIG. 4.

The pulser coils 28 are mounted on an annular more 29 which is, in turn, journaled on the cylinder block 12 by means of a spark timing plate 31. The angular position of the spark timing plate 31 will control the time at which the spark plugs 21 are fired, in a manner to be described.

A combined throttle and spark control mechanism, indicated generally by the reference numeral 33, is provided for controlling the position of the throttle valves 16 and also the angular position of the spark timing plate 31. This mechanism includes a pair of bowden wire actuators 33 that are connected by fasteners 30 to a drum 34 which is supported for rotation on the cylinder block 12 by means of a pivot bolt 35. An anti-friction bushing 36 encircles the pivot shaft 35 and is held in place by means of a further bushing 37 and washer 38 so that the drum 34 may freely rotate on the pivot shaft 35. The bowden wire actuators 33 are connected to a remotely positioned operator controlled lever (not shown) so as to permit the operator to select the speed of operation of the engine 11.

The drum 34 has a throttle control arm 39 that carries a ball connector 41 (FIG. 2) that affords a universal joint connection to one end of a throttle control link 42. The other end of the throttle control link 42 has a corresponding connection to a throttle control cam 43 that is journaled on the intake manifold 15 by means of a pivot bolt 44. The throttle control cam 42 cooperates with a roller follower 45 that is fixed to the throttle controlling lever 18 of one of the carburetors 13 for providing control in the positioning of the throttle valve 16 of one of the carburetors 13. A link 46 interconnects the carburetor throttle control levers 18 so that movement of the throttle valve 16 of one of the carburetors 13 will effect simultaneous movement of the throttle valve 16 of the other carburetor 13.

An intermediate drum 47 is journaled upon the bushing 36 of the pivot shaft 35 adjacent the throttle drum 34. The throttle drum 34 has a lug 48 that normally engages a projection 49 on the intermediate drum 47 so that rotation of the drum 34 in the closing (counterclockwise) direction will cause simultaneous rotation of the intermediate drum 47 in this same direction. A torsional spring 51 is contained and loaded between the drum 34 and 47 so as to normally effect clockwise rotation of the intermediate drum 47 when the throttle controlling drum 34 rotates in the throttle opening (clockwise) direction.

The intermediate drum 47 has a further lug or arm 52 that is engaged, in the idle position, with an adjustable stop 53 carried by the engine cylinder block 12 so as to set the idle position for the throttle controlling drum 34 and intermediate drum 47.

A spark control lever 54 is journaled on the bushing 36 and pivot pin 35 adjacent the intermediate drum 47. A torsional spring 55 has one end 56 affixed to the spark control lever 54 and its other end fixed to the intermediate drum 47 so as to provide a resilient driving connection between the drum 47 and spark control lever 54. This connection normally causes the drum 47 and spark control lever 54 to rotate with each other in both directions. However, the spring 55 will yield under conditions to be described, so as to permit lost motion for reasons to be described.

The spark control lever 54 has affixed to its upper end on end of a link 57 by means of a ball connector 58. The link 57 is connected at its other end to an arm 59 of the spark control plate 31 for rotating the plate in response to rotation of the arm 54. The idle spark advance is set by an adjusting screw 61 that contacts a lug on the spark control arm 54 so as to control the spark advance at idle.

Figure 5:
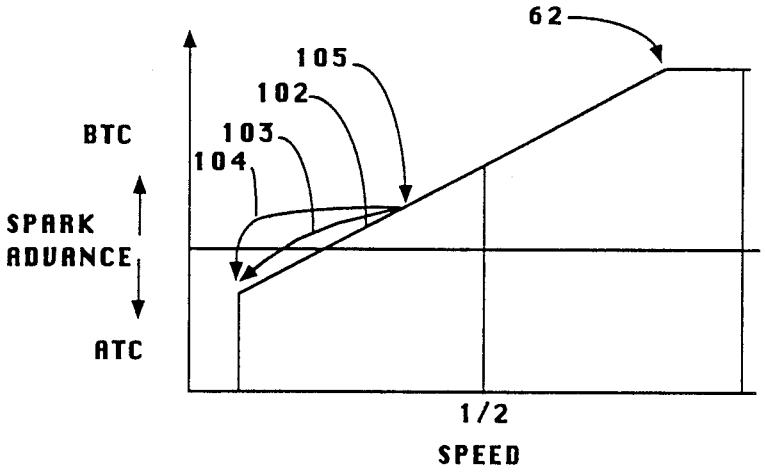
FIG. 5 is a graphical view showing the spark advance curve of this embodiment.

In FIG. 5, the normal spark advance curve of the engine in response to engine speed is indicated by the line 62. It should noted that as the drum 34 rotates in a clockwise direction so as to increase the opening of the throttle valve 16 through the linkage system aforedescribed, the spark control lever 54 will initially be held in the fixed advance, idled state. Eventually the lug 52 of the intermediate drum 47 will control the spark control lever 54 and the lever 54 will rotate in a clockwise direction so as to advance the spark from the idle spark along a generally straight line function. Eventually, a point will be reached when the spark advance lever 54 contacts an adjustable stop 63 and at this point, which is something less than the maximum speed of the engine, further spark advance will be stopped and the intermediate drum 47 and spark control lever 54 will be held in position. The torsional spring 51 will yield under this condition to permit the throttle control drum 34 to move to its full throttle position. As the throttle control drum 34 is rotated in the counterclockwise direction to control to slow engine speed, the operation will occur in the opposite direction, that is, the spark advance curve 62 will be followed downwardly except under conditions of extreme deceleration, as will be described.

Figure 4:
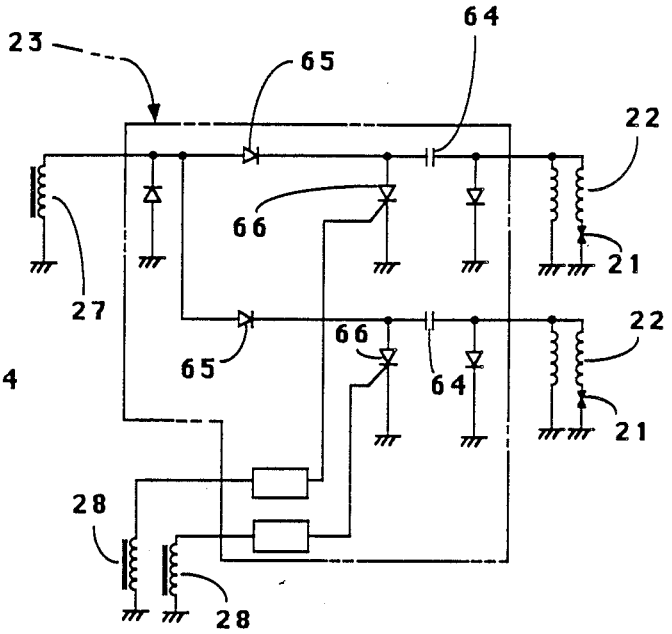
FIG. 4 is a schematic view showing the ignition system of the engine of this embodiment.

FIG. 4 shows the ignition circuit for firing the spark plugs 21 and specifically the spark control device 22. This is of the general SCR type and includes a charging capacitor 64 for each of the spark coils 22 which is charged from the charging coil 27 through a rectifying diode 65. The pulser coils 28 are connected to gates of SCRs 66 and will render the gates conductive at the appropriate spark angle, as determined by the angular position of the spark control plate 31 so as to discharge the capacitors 64 and generate a voltage in the secondary winding of the coils 22 for firing the spark plugs 21 in a known manner.

Figure 6:
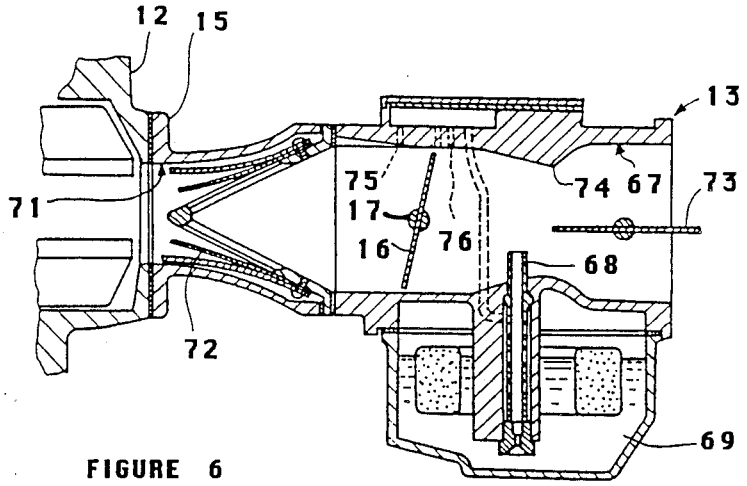
FIG. 6 is a cross-sectional view taken through one of the carburetors of this embodiment and shows its relationship to the crankcase chambers of the engine.

FIG. 6 shows the details of the carburetors 13 and it will be noted that each carburetor 13 has an induction passage 67 which the throttle valve 17 is positioned. Upstream of the throttle valve 17 is a main discharge nozzle 68 that supplies fuel from a fuel bowl 69 for distribution to the crankcase chambers through an intake passage 71 of the manifolds 15. A reed type check valve 72 is positioned therein so as to prevent reverse flow, as is well known in this art.

A choke valve 73 is positioned in the induction passage 67 upstream of the venturi section 74 and the discharge nozzle 68 for cold starting enrichment. The carburetor also includes idle ports 75 and transition ports 76 that deliver fuel to the engine under low speed running.

It should be readily apparent that as soon as the throttle valve 16 is instantly closed, that sole fuel will still be delivered by the idle port 75 and this fuel may cause uneven running and even stalling if not properly burned within the combustion chambers. In order to provide proper spark timing under this condition, there is provided a dash pot assembly, indicated generally by the reference numeral 76 and shown in most detail in FIGS. 2 and 3 which dash pot assembly is responsive to sudden decelerations for providing an advanced spark curve the shape of which is dependent on the degree of deceleration and avoiding the aforenoted deleterious effects.

The dash pot 76 is comprised of an outer housing made up of a molded plastic housing 77 and a cover 78 that has a flange 79 joined over the housing 77 to secure these parts together and to confine the outer peripheral edge of a diaphragm 81. The diaphragm 81 divides the interior of the housing into an atmospheric chamber 82 that is exposed to atmospheric pressure through an opening 80 in the housing 78 and a pressure chamber 83. The pressure chamber 83 is exposed to the atmosphere through a perforated cap 84 and cover piece 85 through a restricted orifice 86. The orifice 86 restricts the rate of flow of air from the chamber 83 to the atmosphere through the screen 84 when the diaphragm 81 is moved to the left as shown in this figure, for a reason to be described.

A one way check valve 87 also communicates the chamber 83 with the atmosphere through the screen 84. The one way check valve 87 normally closes relief passages 88 that will opened at a relatively low pressure difference so as to permit the diaphragm to move rapidly to the right to the position shown in FIG. 3.

A pair of rigid plates 89 and 91 are affixed to opposite sides of the diaphragm 81 and secure the diaphragm 81 to a piston rod 92. The piston rod 92 is slidably supported within bushing 93 formed on a mounting flange portion 94 of the dash pot assembly 73. The mounting flange portion 94 is provided with elongated slots 95 so as to facilitate attachment of the dash pot assembly 76 to the cylinder block 12 by means of threaded fasteners 96. The piston rod 92 is normally urged to an extended position by means of a coil compression spring 97 that engages a washer 98 fixed, as by a snap ring, to the piston rod 92. A boot 99 encircles the spring 97 and protects an anti-friction bushing 101 that supports the piston rod 92.

As the spark lever 54 moves away from its normal idle position, the spring 97 will urge the diaphragm 81 to the right so as to contract the volume of the chamber 81 and expand the volume of the chamber 83. As has been previously noted, the check valve 87 allows the unrestricted flow of air into the chamber under this condition through the relief openings 88.

If the throttle valves are closed slowly, the spark lever 54 will engage the rod 92 and move it to the left and expel air from the chamber 83 through the restricted orifice 86. This assumes normal throttle closing and under this condition there will be no significant retardation of the movement of the spark control lever 54. If, however, the spark control lever 54 is abruptly closed due to rapid closing of the throttle valves 16, the dash pot assembly 76 will retard the rate of movement of the spark control lever 54 under conditions of rapid closure of the throttle valve and rather than following the spark control curve 62, one of the curves 103 or 104 will be followed from the point 105 downwardly (the point at which the piston rod 92 is engaged) so as to prevent the spark retardation from the normal curve portion 102. As a result, the spark is advanced under this condition from that normally dictated by the engine speed and the deleterious effects of running (unevenness or stalling) will be avoided. It will be noted that the more rapidly the throttle is closed, the more the spark advance will occur as the curve 103 shows a somewhat slower rate of spark control lever 54 movement than the curve 104.

Figure 7:
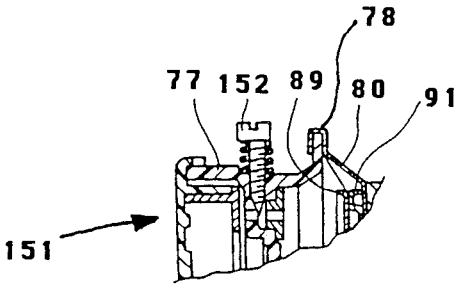
FIG. 7 is a partial cross-sectional view, in part similar to FIG. 3, showing a further embodiment of the invention.

FIG. 7 shows an embodiment of the invention which is generally the same as the previously described embodiment. However, in this embodiment a dash pot 151 is employed in which rather than a fixed orifice there is provided an adjustable orifice 152 for adjusting the effective air flow and controlling the rate of spark advance under extreme deceleration conditions.

Figure 8:
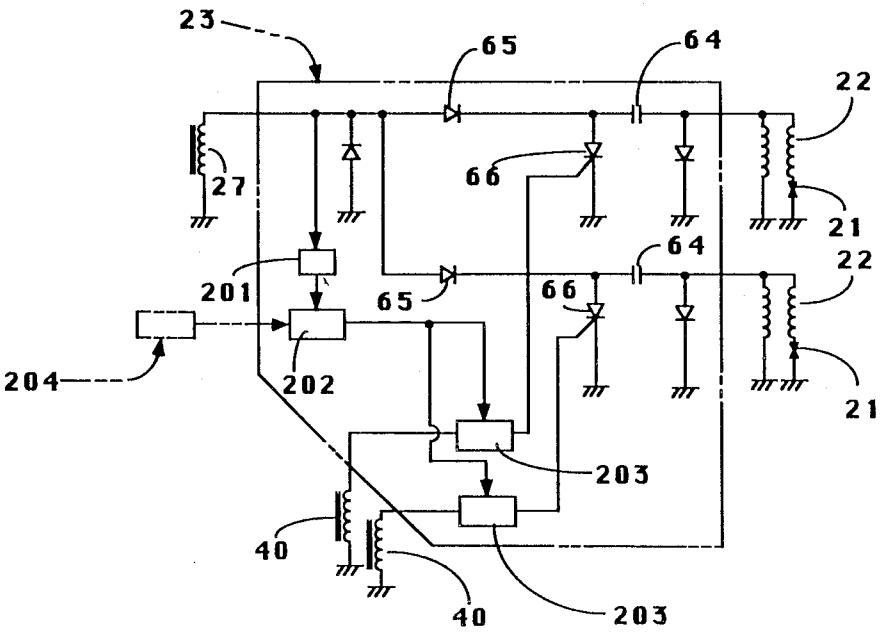
FIG. 8 is a schematic diagram of the ignition system of an internal combustion engine constructed in accordance with another embodiment of the invention and is otherwise generally similar to FIG. 4.

In the embodiments of the invention as thus far described, there has been provided a dash pot for retarding the movement of the spark control lever 54 for advancing the spark timing under extreme deceleration conditions. In addition to the use of such a mechanical device, the spark may be advanced in response to extreme decelerations by means of an electronic control system and such a system is shown in FIG. 8.

Figure 9:
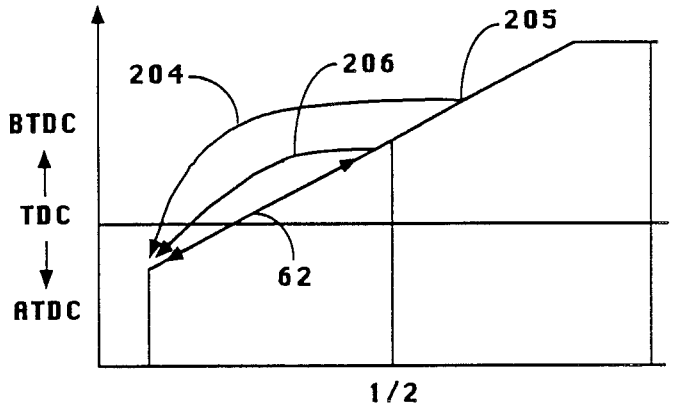
FIG. 9 is a graphical view showing the spark advance curve in accordance with this embodiment of the invention.

In this figure, the output of the charging coil 27 is also transmitted to a wave formed shaping circuit 201 that outputs a signal to a control device 202. The control device 202 is programmed in response to engine parameters including the rates of deceleration so as to output a signal to a further have formed shaping circuit 203 which will trigger the SCRs 66 and achieve spark timing in accordance with a predetermined map such as that shown in FIG. 9. In this map, the normal spark advance curve 62 may be deviated by a first spark advance curve 204 at an engine speed 205 which is greater than the engine speed at which the dash pot 76 of the previously described embodiments operated out still at speeds relatively low and substantially less than maximum speed. Thus, under very sudden decelerations, a more advanced state of spark advance may be accomplished. Under more modest decelerations the curve 206 will be followed. Of course, under, normal deceleration the curve 62 will be followed. If desired, a speed control signal 204 also may be inputted to the controller 202 so as to achieve the spark advance.

Figure 10:
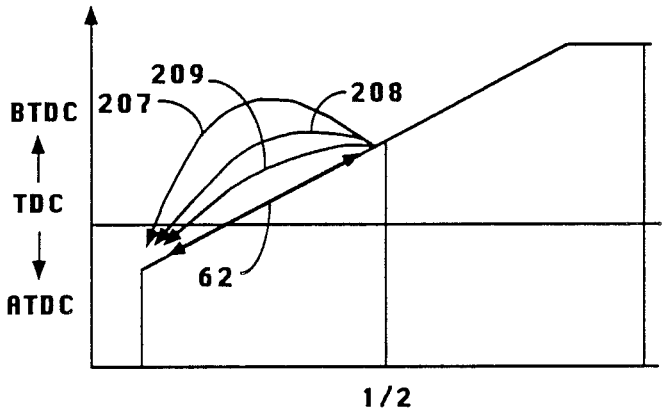
FIG. 10 is a graphical view, in part similar to FIGS. 5 and 9 and shows yet another embodiment of the invention.

In addition to causing the spark advance to occur at different engine speeds, the electronic system may also cause the spark advance to be advanced over that provided for by the curve 62 and which is obtained merely by delaying the movement of the spark control lever 54 as shown by the various curves 207, 208 and 209 in FIG. 10 at low engine speeds. A wide variety of other modifications is possible with the use of the electronic system including combinations of those described.

It should be readily apparent, therefore, that a number of embodiments of the invention have been illustrated and described, each of which is operative to provide an optimum spark advance condition in response to the sensed rate of deviation from normal throttle positioning. Although a number of embodiments of the invention have been illustrated and described, various changes and modifications may be made without departing from the spirit and scope of the invention, as defined by the appended claims.

Claims:

1. In an ignition timing control for a spark ignited internal combustion engine and for improving running levels during extreme deceleration, comprising a throttle control for controlling the speed of the engine, spark control means for providing a first normal spark advance curve in relation to engine speed under normal changes in engine speed, means for determining the existence of a movement of said throttle control to effect a rapid reduction in engine speed that could effect uneven running, and means for effecting an advance in the spark timing from said normal spark advance curve in response to the determining of the existence of movement of said throttle control to effect a rapid rate of deceleration of engine speed comprising a spark control lever supported for pivotal movement in response to changes in position of the throttle control and connected to said throttle control by means including resilient biasing means and damping means acting upon the park control lever for retarding the movement of the spark control lever under the movement of the throttle control toward its idle position.

2. An ignition timing control for a spark ignited internal combustion engine as set forth in claim 1 wherein he damping means comprises a dash pot.

* * * * *